US005711336A

United States Patent [19]

Nirmel

[11] Patent Number: 5,711,336

[45] Date of Patent: Jan. 27, 1998

[54] SUNBATHER'S SHELTER AGAINST CHILL WINDS AND WIND-BLOWN SAND

[76] Inventor: Chittaranjan N. Nirmel, 1108 Portner Rd., Alexandria, Va. 22314

[21] Appl. No.: 685,749

[22] Filed: Jul. 24, 1996

[51] Int. Cl.[6] ..... E04H 17/00; E04H 15/00

[52] U.S. Cl. ..... 135/87; 256/12.5; 52/DIG. 2; 135/902; 135/116; 135/119

[58] Field of Search ..... 135/87, 156, 157, 135/116, 119, 120.1, 900, 902; 52/63, 222, DIG. 12; 47/33; 256/12.5, 45; 405/21, 22

[56] References Cited

U.S. PATENT DOCUMENTS

| | | | |
|---|---|---|---|
| 1,465,894 | 8/1923 | Crowley | 256/12.5 |
| 1,930,404 | 10/1933 | Wagner | 256/12.5 X |
| 3,226,091 | 12/1965 | Root | 256/12.5 |
| 3,404,696 | 10/1968 | Filho | 135/902 X |
| 4,860,777 | 8/1989 | Orlando | 135/902 X |
| 4,875,549 | 10/1989 | Denny et al. | 52/63 X |
| 4,966,181 | 10/1990 | Liberman et al. | 135/902 X |
| 4,969,500 | 11/1990 | Makosa | 135/902 X |
| 4,981,152 | 1/1991 | Laurent | 135/900 X |

FOREIGN PATENT DOCUMENTS

| | | | |
|---|---|---|---|
| 0100238 | 11/1940 | Sweden | 135/87 |

*Primary Examiner*—Robert Canfield

*Attorney, Agent, or Firm*—Chittaranjan N. Nirmel

[57] ABSTRACT

A light-weight shelter to protect a user from exposure to chill winds and material entrained therein has a peripheral wall inclined inwardly. The upper edge of the wall is supported by substantially vertical elements which also hold down the lower edge of the wall. Wind-entrained material, upon contacting the outer surface of the inwardly inclined wall, initially will tend to move upward. The wind passes over a sheltered zone defined within the wall, and any entrained matter is slowed down by friction with the wall and eventually falls to accumulate around a bottom edge outside of the wall. In one aspect of the invention, the wall is attached to a base having an outwardly extending portion on which the initially entrained particulate matter accumulates, and one or more outwardly extending flanges are provided to extend outwardly from the wall to even more effectively intercept entrained particulate matter from oncoming wind. The wall may be made to any suitable height. To facilitate stepping over to enter or leave the sheltered zone within, in another aspect of this invention a portion of the upper edge of the wall is made to extend downward to a convenient height.

34 Claims, 7 Drawing Sheets

FIG. 1 (A)

SUNBATHER'S SHELTER AGAINST CHILL WINDS AND WIND-BLOWN SAND

FIELD OF THE INVENTION

This invention relates to a shelter for protecting a reclining person, such as a sunbather, against chill winds and sand or other jetsam entrained therein, and more particularly to an easily erected, lightweight, and relatively inexpensive shelter which enables a user to enjoy sun and sky while sheltered against discomfort due to wind and wind-carried material particularly when the ambient temperature is uncomfortably low.

BACKGROUND OF THE INVENTION

It is relaxing and pleasurable to occasionally lie down in the open, to feel the sun and see the sky, and perhaps to enjoy the benefits of sunbathing. For people living in the temperate and northern zones, such activity is limited by the seasons. In the northern hemisphere, for example, all the way from Morroco to Siberia, the cold days of spring and autumn generally limit the comfortable sunbathing and beach enjoyment period to summertime only. Specifically, for people living in northern Europe, the upper United States and Canada, low temperature, chill winds, and wind-blown sand tend to limit open sunbathing to a period extending from about early June to late September.

Determined individuals create shelters, typically using sticks poked vertically into the ground, with cloth or plastic sheets tied to the sticks to create local windbreaks. These usually are not successful, even if formed to have a completely closed periphery. The principal reason is that wind gusts tend to exert too much force on the substantially vertical sheets which, consequently, either tear or billow away. Furthermore, wind tends to get past the bottom edges, particularly when the sheet is distorted by wind pressure, so that cold wind and entrained sand blows directly on the sunbather lying downstream. Even if the ambient temperature is not uncomfortably low, the impingement of jetsam such as sand particles and trash carried by the wind is uncomfortable, e.g., when sand gets in the user's eyes, nose and ears. Due to such difficulties, there is at present relatively limited enjoyment of the benefits of sunbathing and outdoor rest.

Since conventional solutions are not successful, there exists a real need for a lightweight and effective shelter against wind and jetsam entrained therein.

SUMMARY OF THE INVENTION

It is a principal object of this invention to provide a user shelter from wind and any jetsam entrained therewith while allowing exposure to sun and sky.

It is another object of this invention to provide an apparatus which will shelter a user from wind in such a way that any jetsam entrained therewith, e.g., sand and/or particulate debris, in such a way that the jetsam is intercepted and prevented from impinging on the user.

It is yet another object of this invention to provide a relatively inexpensive, lightweight, easily set-up and dismantled, inherently stable apparatus for sheltering a user seeking exposure to sun and sky from the discomfort of contact with wind and jetsam entrained therewith.

These and other related objects of this invention are realized by providing an apparatus for sheltering from wind and any jetsam entrained therewith, which includes a wall having a lower edge and an upper edge and extending therebetween to define an open sheltered zone, with wall-support means provided for supporting substantially the entire upper edge above the lower edge so that a substantial portion of the wall is inclined toward an interior of the sheltered zone.

In another preferred embodiment, the apparatus includes jetsam intercepting means, preferably in the form of at least one flange extending outwardly away from the outer surface of the wall above the lower edge.

In yet another preferred embodiment, there is provided an apparatus which, in addition to the inclined wall and the jetsam intercepting means, includes a base extending from a lower edge of the wall outwardly of the sheltered zone.

In an even further aspect of the invention, according to another preferred embodiment, there is provided an apparatus for sheltering a user from wind and any jetsam entrained therewith, which has a wall having a lower edge and an upper edge and extending therebetween to define an open sheltered zone. Wall-support means are provided for supporting substantially the entire upper edge above the lower edge so that a substantial portion of the wall is inclined toward an interior of the sheltered zone. Jetsam intercepting means are provided for intercepting any jetsam driven by wind over an outer surface of the wall. The apparatus includes a base attached to the lower edge of the wall, the base having an inside portion which extends inwardly from the lower edge of the wall to define a lower surface of the sheltered zone, and an outside portion which extends from the lower edge of the wall outwardly from the sheltered zone.

These and other aspects and benefits of the invention will be better understood by reference to the drawing figures and as described more fully hereinbelow.

DETAILED DESCRIPTION OF THE PREFERRED EMBODIMENTS

This invention, in all of its embodiments, is intended to be useful for its intended purposes when erected over any terrain where shelter is desired against the chilling effects of wind and the discomfort associated with impingement by any jetsam entrained therewith on a user reclining to enjoy sun and sky. Each of the embodiments is useful over a grassy lawn, a sandy beach, hardpacked dirt, ground covered in pebbles, and the like. So long as provision can be made for supporting the structure in its intended manner, all of the embodiments may be used even over a manufactured surface, e.g., an outside deck, a paved area, a flat roof, or even the top of a camper or van. The structural details, manner of deployment and use, and the particular advantages of individual embodiments are provided in detail.

Figure 1:
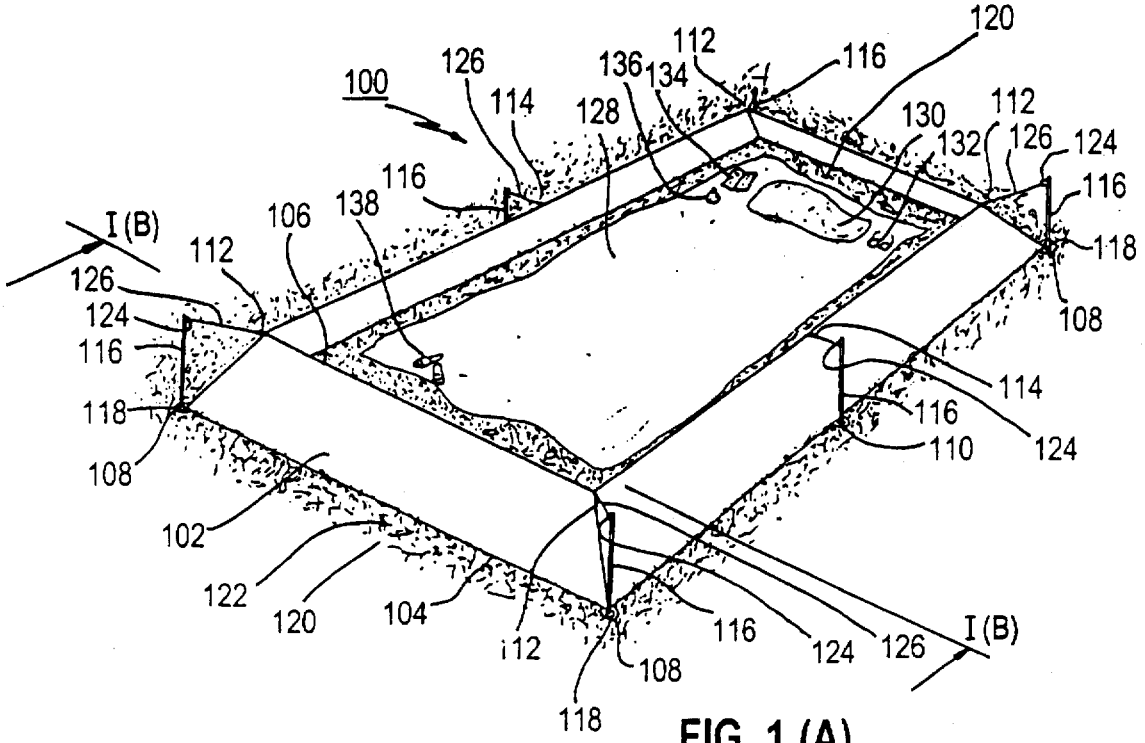
FIG. 1(A) is a perspective view of the first preferred embodiment of the apparatus of this invention, shown erected over grassy ground.
FIG. 1(B) is a vertical cross-sectional view thereof, taken at Section I(B)—I(B).
Figure 1:
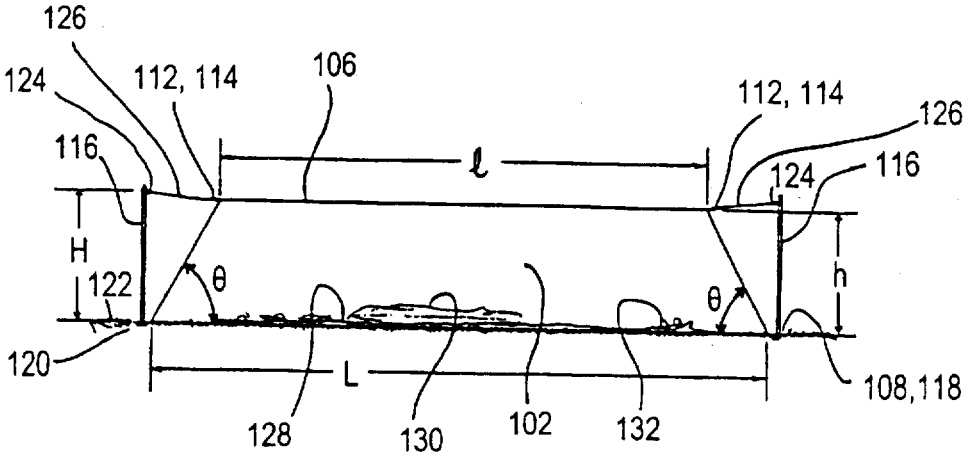

The first preferred embodiment, the simplest form of the structure, is shown in FIGS. 1(A) and 1(B). As best seen in FIG. 1(A), the shelter 100 has a continuous or endless wall 102 which extends from a lower edge 104 to an upper edge 106. An important aspect of this invention is that a substantial portion of wall 102 be inclined inwardly toward an interior circumscribed by the wall and its upper and lower edges. As best seen in vertical cross-sectional view in FIG. 1(B), taking the underlying support surface as horizontal, a preferred inclination of the wall relative thereto is θ, which preferably has a range 50°–80° from the horizontal.

Outwardly extending flaps 108, 108 are provided at each of the corners formed in the lower edge 104. Additional outwardly extending flaps 110 may be provided at one or more locations on the lower edge 104 between adjacent corners if a particular segment of the wall is particularly long.

At each of the corners formed in the upper edge, there is preferably provided an outwardly extending flap or loop 112 to allow engagement thereat with means for support. Additional loops 114 may be provided at one or more locations at the upper edge 106, preferably in correspondence with any flaps 110 provided at lower edge 104. Any other comparable support connection, e.g., a ring, hook, etc., may be used with equal facility.

A plurality of substantially vertical support elements 116 are located with their lower edge portions passing into ground underneath through respective grommets 118 provided in corresponding flaps 108, 110. Additional details of support elements 118 and the manner in which they cooperate to support the wall as intended are described below with reference to FIGS. 6–8. Each support element 116 has a lower end portion formed to cooperate with the corresponding grommet 118 to hold the corresponding flap, i.e., 108 or 110, firmly in close contact with the underlying ground surface 120.

In the arrangement illustrated in FIGS. 1(A) and 1(B) the ground is intended to be shown covered with mowed grass 122. Therefore, as will be appreciated, the respective bottom surfaces of flaps 108, 110 will be firmly pressed into the grass over the ground surface during useful deployment of the shelter. Also, and as a direct and intended consequence, by suitable stretched-out location of the corners of the lower edge 104 the actual edge portions of wall 102 will be held so that the grass on both sides of the lower edge 104 will rise above and very close to the lower edge. Such an interaction between the lower edge 104 and the grass upon which it presses and the additional grass on both sides of the wall 102 is intended to serve as a very effective flexible sealing mechanism which will impede passage of air from the outside of lower edge 104 into the interior space defined by the peripheral expanse of wall 102. In other words, by holding down the lower edge 104 of the wall in very close firm contact with the ground around the entire periphery, it is intended that any ground level wind be forced to go around the wall or to be directed upwardly along its inclined surface rather than to travel directly into the interior sheltered zone circumscribed by the peripheral wall 102.

Figure 6:
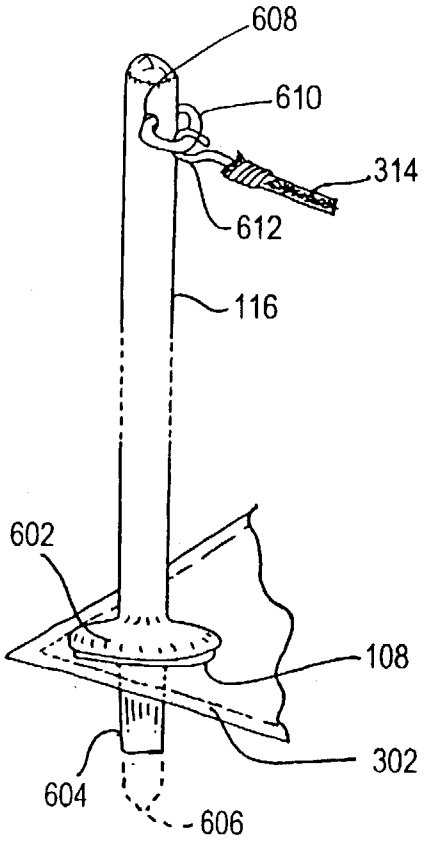
FIG. 6 is a fragmented perspective view of a wall-supporting post disposed through a corner portion of the base of the apparatus according to any of the second through fifth embodiments.
Figure 7:
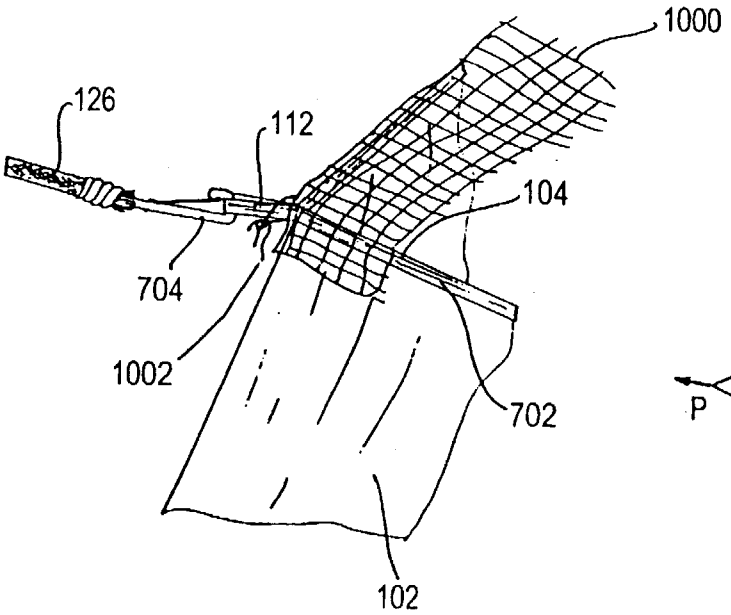
FIG. 7 is a fragmented perspective view of an upper corner portion of the apparatus according to the second embodiment.
Figure 8:
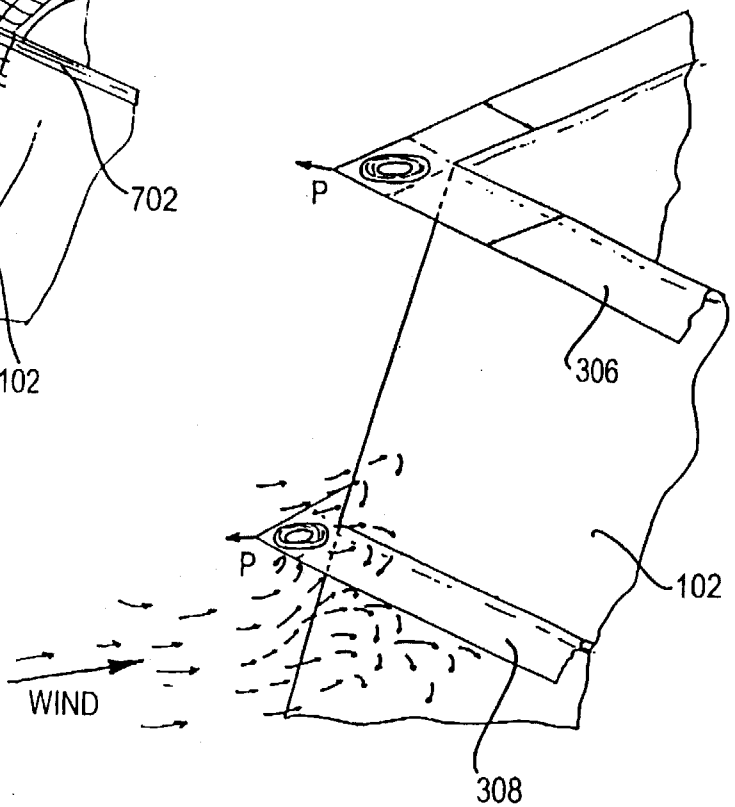
FIG. 8 is a fragmented perspective view of an upper corner portion of the apparatus according to any of the third through fifth embodiments.

Near the upper end of each support element 116 is provided a known means 124 to enable attachment of an outside end of a corresponding flexible connecting element 126 an inner end of which is connected to a corresponding loop 112 or 114. Details of such elements are illustrated in FIGS. 6, 7 and 8 and are discussed more fully hereinbelow.

As will be readily apparent from the above description, when the apparatus according to the first preferred embodiment is thus deployed, there is brought into effect a flexibly supported and inwardly inclined peripheral wall 102 which surrounds an interior zone within which a user may find shelter from low-level wind and jetsam, e.g., grass cuttings and the like in this instance, entrained therewith. As indicated in FIGS. 1(A) and 1(B), a user may place a sheet, a blanket or a padded element 128 within the periphery of wall 102, with typical items of personal convenience or use, e.g., a pillow 130, sunglasses 132, a book 134, a bottle of lotion 136, or a pair of slippers 138. All such items, therefore, are also sheltered against being blown around or being coated with dirt yet are within easy reach of the user.

Although the above description focuses on the first preferred embodiment as illustrated in FIGS. 1(A) and 1(B), there are numerous aspects common to all of the disclosed embodiments of the invention. These are summarized in the immediately following paragraphs.

Note that although the exemplary structure in its various embodiments as illustrated in the figures is indicated as having a generally rectangular shape with inclined wall sides, this is not intended to be limiting. It is expressly intended that the overall peripheral shape defined by the upper edge and/or the lower edge of the wall be freely selectable by the manufacturer of the shelter to suit particular needs of individual users. The key is that regardless of the shape of the interior sheltered zone, it is defined within and by the inclined wall 102. The peripheral outline of inclined wall 102 may thus be of any shape, e.g., polygonal, triangular, circular, oval, etc. Depending on the selected shape and the length of the upper and lower edges, reasonable numbers of flaps 108,110 and support elements 116, etc. must be provided in obvious manner. This is generally true, with obvious variations, for all embodiments of this invention. The actual numbers must be selected in light of the anticipated conditions of use, but adequate support must be provided at all corners.

Also, although the figures show all segments of wall 102 inclined inwardly relative to the upper edge 104, this is not essential. A portion of wall 102 may be vertical to the local horizontal, and in principle may even be inclined outwardly, so long as that portion of wall 102 which faces the prevailing wind is inclined inwardly. Furthermore, although the height of upper edge 106 relative to lower edge 104 is shown as being consistently the same around the entire periphery of wall 102, this also is not intended to be limiting, but is merely exemplary. In other words, one or more portions of inclined wall 102 may have their corresponding portions of upper edge 106 at different heights relative to corresponding portions of the lower edge 104. In the event that such a configuration is utilized, it would be preferable to have the higher portions of wall 102 facing toward the direction from which the prevailing wind approaches the structure, so that the protection from the wind is thereby maximized where it is most needed.

Note that support elements 116 may be made of any convenient material, e.g., fiberglass rod, plastic tubing, metal tubing or rod, wooden dowels, or the like. Numerous such support elements are known and employed with camping equipment, and the choice of material, cross-sectional area, and details of structure at the upper and lower ends are all considered to be matters of design choice and are not deemed to be critical. This is true for all embodiments.

Equally true for all embodiments is that the height "H" where the connecting element 126 joins with the support element 116 should be somewhat higher relative to the lower edge 104 than the height "h" separating the lower and upper edges 104, 106 relative to each other at the location closest to the supporting element 116. Obviously, if the wall 104 is formed so that it has different heights at different portions, the corresponding support elements 116 must have suitable heights.

Connecting elements 126 may have any convenient known form, e.g., cord, chain, band, strap, or the like, and may also have some elasticity. The opposite ends of each connecting element 126 may be provided with respective known types of connection means, examples of which are discussed with reference to FIGS. 6, 7 and 8 below. It is considered highly desirable that "H" be somewhat larger than "h" so that each connecting element 126 rises somewhat as it extends outwardly from its connection with a corresponding loop 112,114 toward the corresponding connecting element 124. The flexibility and/or elasticity of each connecting element 126, and this upward inclination, together should maintain upper edge 106 in generally stretched-out and taut manner above lower edge 104.

For a generally rectangular structure, as illustrated in the figures, for the use by a single individual it is considered that the length "L" for a shorter side of the rectangular shape is preferably in the range 6–8 ft., that the longer sides each preferably be in the range 8–10 ft., that the height "H" be in the range 12–30 in., and that the difference between "H" and "h" be in the range 2–5 in. These are merely preferred or recommended figures, and the exact magnitudes are considered to be matters of design choice and are not deemed to be critical. The height "h" should be high enough to assure the user sufficient protection from wind even if there is no debris blown around. As persons of ordinary skill in the art will readily appreciate, there is fundamentally no reason why the above-discussed dimensions cannot be extended even further to suit specific needs.

The material of wall 102 preferably should be lightweight, strong, relatively inexpensive, easy to clean, and capable of resisting rot due to fungi and/or moisture. In other words, it is intended that the apparatus be affordable, that it be easy for the user or users to carry to its point of use, that it be long-lasting, that it be easy to clean if it gets dirty, and that it be capable of resisting rot and decay which might otherwise be incidental to being left wet for long periods between cleanings. Numerous suitable materials are commercially available, and include but are not limited to polyester, nylon, rayon, and other types of fabrics with or without plastic coating or impregnation. Coated materials may be provided a light-colored reflective surface at substantial portions or on all of the inside surface of wall 102 to assist sunbathers by reflecting sunlight within the sheltered zone. The exact choice of material is not considered critical in any of the embodiments. This is also true of the material employed to make loops 112 and flaps 108, 110. If shelters according to this invention are to be used as rental equipment, and/or are otherwise likely to be handled by persons exercising varying degrees of care, reinforcement tapes, cord-piping along the upper and lower edges, etc., would be advisable.

In the embodiment per FIGS. 1(A) and 1(B), each flap 108, 110 is preferably provided with a substantially flat known kind of metal or plastic grommet 118 having an aperture sized to closely receive therein the lowermost portion of a corresponding support element 116, the projecting portion being driven forcibly into the ground below through the grommet and its respective flap. The portion of upright element 116 which lies immediately above the corresponding grommet 118 may conveniently be shaped and sized to facilitate handling by the user and the application of pressure, during use, over the corresponding grommet and flap. Such details are discussed below with reference to FIG. 6.

To deploy the embodiment of FIGS. 1(A) and 1(B), the user may unpack a previously tightly folded peripheral wall 102 and a set of support elements 116 and connecting elements 126. Starting at one corner, the user should extend the corresponding flap 108 outwardly and drive the lowermost portion of support element 116 vertically therethrough to locate that flap and corner close to the ground thereat. The user should then determine, as best possible, the direction of the prevailing wind, and extend generally perpendicular to that direction one of the two walls that meet at the just-located corner. The user should then drive the lowermost end of a second connecting element 116 through the grommet 118 of a flap at the other end of the lower edge 104 of that portion of the wall so that it is tightly extended close to the ground. Similar action with the other corners should ensure that all four corners are firmly located and connected to the underlying ground by the four corner supporting elements. The corners of the upper edge may then be raised and respectively connected by a corresponding connection element 116 having ends passed through the corresponding connecting means 124 and corresponding loop 112 at each corner. The user should then extend outwardly flaps 110, 110 (if provided), drive the lowermost portions of corresponding support elements 116 through the grommets therein, and connect the corresponding flexible connecting elements 126.

The sheltered zone is now defined within the erected apparatus, and the user may place his ground sheet or blanket and personal belongings within. The user may then lie comfortably within the sheltered zone, and the inclined side portions of wall 102 will ensure that any incoming wind is deflected upward and over the sheltered zone. If the structure is correctly erected as described above, the lower edge 104 will remain in close and wind-excluding contact with the grass and/or ground lying underneath. Given the chosen dimensions, the user may even be able to lean on his or her elbows to read a book, which would cause his or her shoulders to rise above the underlying sheet or blanket 128, without feeling the effects of any ambient wind. When the wind dies down, as it occasionally must, the enclosed space will warm up even when the sun is relatively low on the horizon, and incident sunlight may be reflected from the inside surfaces of wall 102, particularly if the wall is provided with a light-colored or deliberately reflective surface. If the wall does not have uniform height all around, and the user has carefully erected the structure so that the highest portion of the wall faces the incoming wind, the sheltering effect may be enhanced. Any incidental jetsam, e.g., grass cuttings, etc., that may be entrained with the oncoming wind will encounter the outer surface of the inclined wall 102, and friction will tend to slow it down. Then, when the wind occasionally diminishes in strength, gravity will cause the jetsam pressed against the outer surface of wall 102 to slide down. Any accumulation of intercepted jetsam outside of and along the lower edge 104 will only improve impedance thereat to any wind leakage into the sheltered zone.

Figure 9:
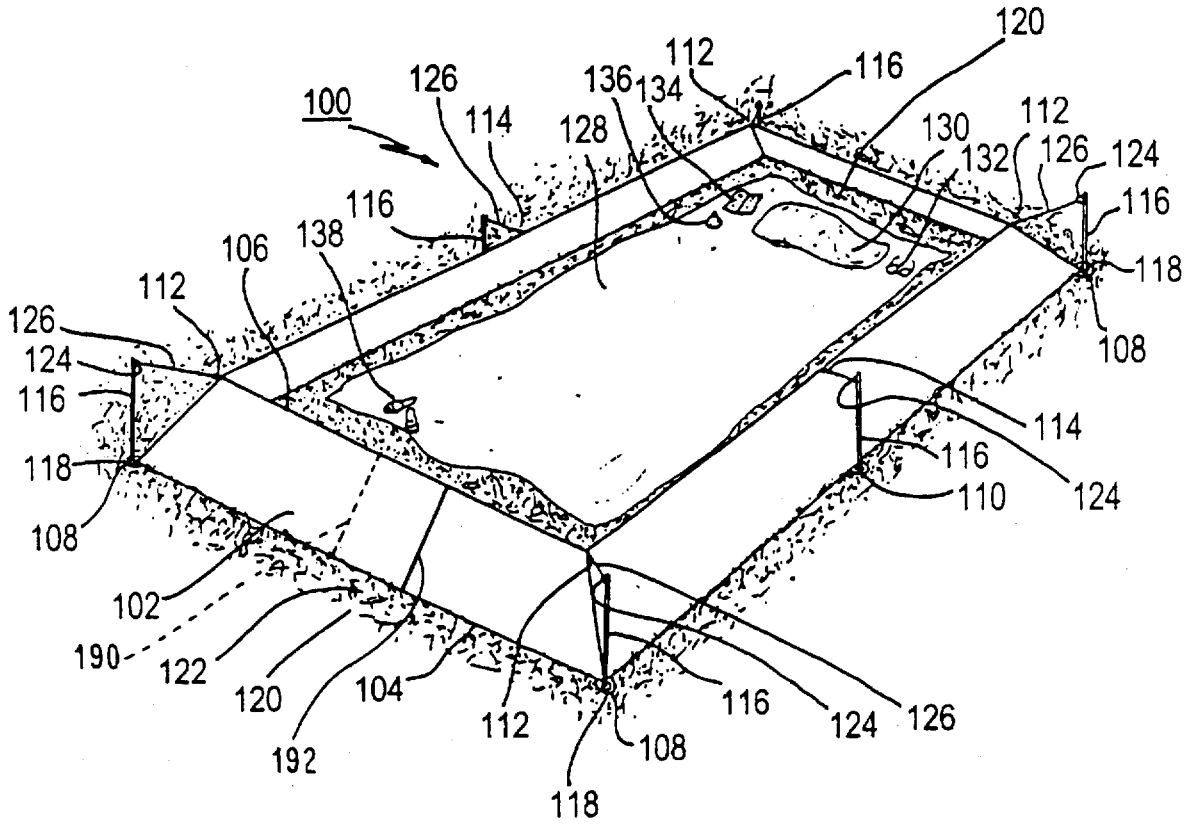
FIG. 9 is a perspective view of a sixth embodiment in which ends of the wall are in an exemplary overlapping relationship.

It should be appreciated that in a variation of the first preferred embodiment, wall 102 instead of having continuous and endless upper and lower edges 106,104 may be elongate and have its ends 190, 192 in an exemplary overlapping relationship, as best seen in FIG. 9, which still defines the sheltered zone within as discussed.

It is not intended, nor can it be realistically expected, that the present invention can protect against all winds regardless of their intensity. It is intended, however, to provide substantial protection and shelter for a user from the otherwise unpleasant effects of chill winds and entrained jetsam, to thus make it possible for the user to enjoy exposure to the sun at the higher latitude in both hemispheres far longer than would otherwise be possible. Such longer use can be experienced in more hours of a given day or days in any year.

It should be appreciated that the embodiment per FIGS. 1(A) and 1(B) can also be effectively utilized on sandy ground, e.g., at a sandy beach. In such use, supporting elements 116 should be forced downward so that via grommets 118 they push tabs 108, 110 downward into the sand and, simultaneously, press lower edge 104 also into the sand. Then, if wind blows sand toward a facing inclined surface of wall 102, friction will slow down the grains of sand and they will, when the wind dies down, slide downwardly and pile up around the outside of wall 102 along lower edge 104 and this will only enhance sealing thereat as discussed earlier.

Figure 2:
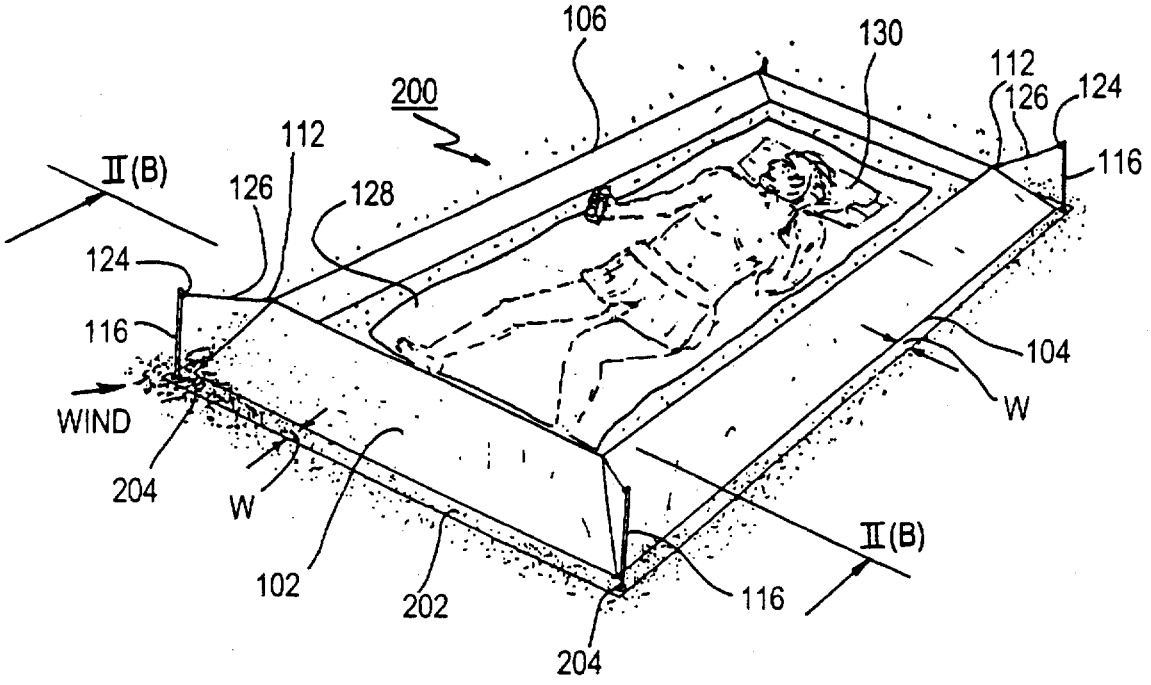
FIG. 2(A) is a perspective view of a second embodiment of this invention, shown erected on sandy ground.
FIG. 2(B) is a vertical cross-sectional view thereof, taken at Section II(B)—II(B).
Figure 2:
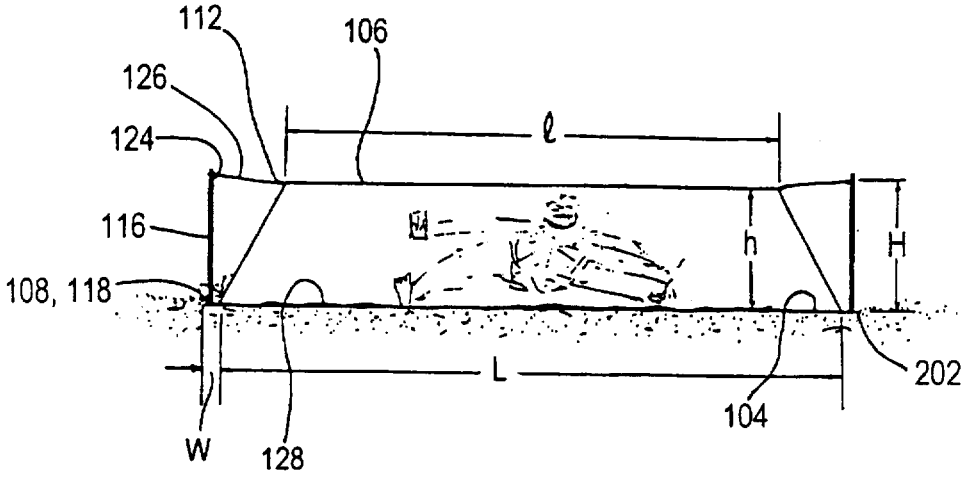

The second preferred embodiment, per FIGS. 2(A) and 2(B), is intended to further exploit such an accumulation of jetsam, particularly sand, along the lower edge of surface 102. To do this, and in the only significant distinction over the preferred embodiment per FIGS. 1(A) and 1(B), the embodiment 200 per FIGS. 2(A) and 2(B) is provided with a flat flexible base portion 202 connected to the lower edge 104 of wall 102 and extending outwardly therefrom. The flaps 108, 110 of the embodiment per FIGS. 1(A) and 1(B) are now, in effect, included within the expanse of base 202. Therefore, base 202 is now provided with corner grommets 204 (and others as needed) through which the lowermost portions of support elements 116 are driven into sand beneath.

Simply to indicate the variety possible, the embodiment of FIGS. 2(A) and 2(B) is shown with only the four corner support elements 116, i.e., the ones at about the middle of the longest sides are omitted. These can obviously be added, but appropriate located grommets comparable to grommets 110 would have to be provided therefor in base 202.

When the embodiment per FIGS. 2(A), 2(B) is employed on sandy ground, with wind blowing in the direction generally indicated by the arrow "WIND", sand entrained in the wind upon being intercepted by the outer surface of wall 102 will slide down and create a sand pile-up 204 which will hold down the nearest portions of base 202. This is a very important aspect of the present invention, namely that what otherwise would have been a disadvantage, i.e., a tendency for the base to flap upward where it faces the wind, because the more sand which the wind brings to that portion of the base the greater will be the accumulation or pile-up 204 of the sand tending to settle on and hold down the base 202 where it faces the wind. Thus, a normally encountered disadvantage is turned into a positive advantage by the present invention. Note that portions of the base 202 sheltered from the oncoming wind by intervening portions of wall 102 probably will therefore have relatively small amounts of acquired accumulations of sand previously entrained in the wind. However, to obviate problems due to sudden changes of wind direction, upon erecting the apparatus per FIGS. 2(A) and 2(B) the user may easily with his foot kick some sand over the upper surface of base 202 all around. Thus, from the very start, the base would be firmly weighted down and the apparatus would thereby be very stably located during use. With this embodiment, as generally indicated in FIG. 2(A), the user must provide his or her own sheet or blanket 120 upon which to rest. Depending on the size of this sheet, there may be some exposed sand around the user but, because the wall 102 prevents the oncoming wind from reaching the user, this sand should not blow around or bother the user.

Figure 3:
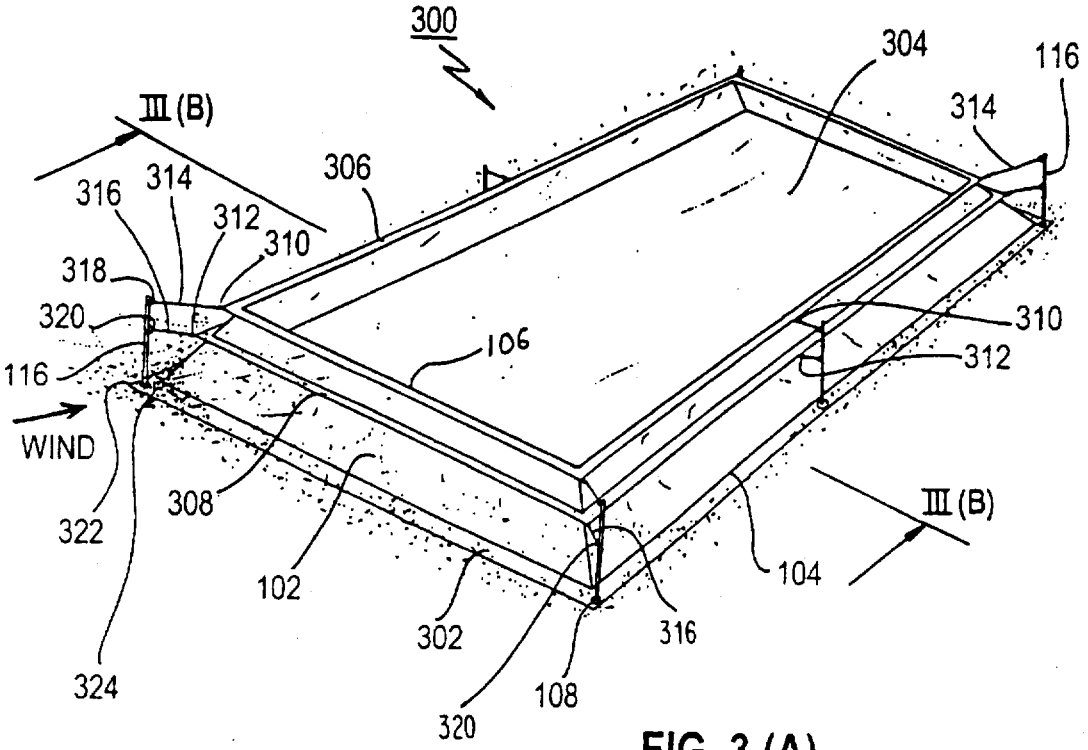
FIG. 3(A) is a perspective view of a third embodiment, shown erected over sandy ground.
FIG. 3(B) is a vertical cross-sectional view thereof, taken at Section III(B)—III(B).
Figure 3:
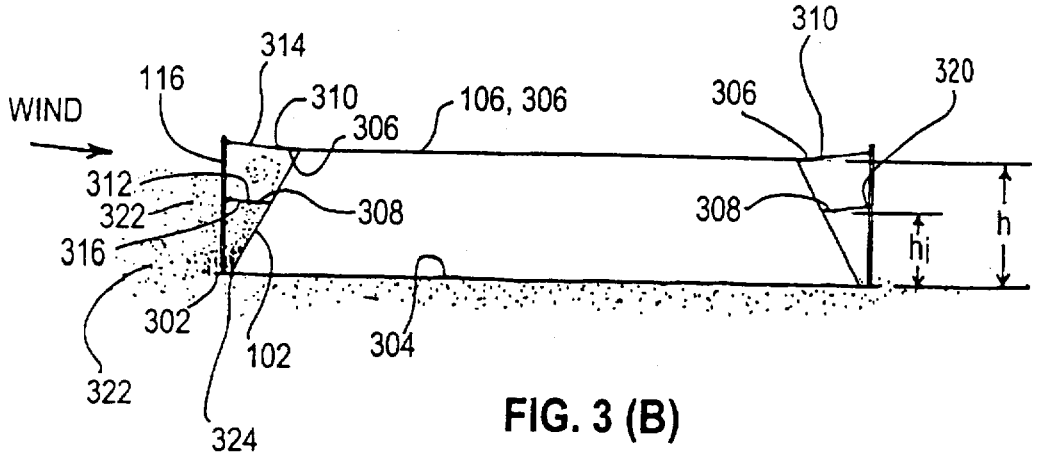

The third preferred embodiment per FIGS. 3(A) and 3(B) differs from the second embodiment per FIGS. 2(A) and 2(B) in that it has a base including an outwardly extending portion 302, preferably 2–5 in. wide, and a preferably coextensive inside portion 304 which extends across the entire expanse circumscribed by lower edge 104. In other words, this structure, when erected, has a sheltered zone in the form of an open box defined by the material of the inside base portion 304 and wall 102.

This third embodiment, therefore, may be very easily utilized over any kind of ground or support surface, which can even be a deck made of separated boards since the presence of the material of inside base portion 304 will prevent the user from feeling any wind which would otherwise pass between the boards. The only change will be in the manner in which support elements 116 are held up, which may be done in any known manner, e.g., by connection flanges or the like. The exact manner of doing this is not considered critical.

The embodiment per FIGS. 3(A) and 3(B) differs from the previously described embodiments in yet another very important respect. This embodiment is provided with two outwardly extending flanges: flange 306 which extends outwardly of and is attached to the upper edge 106, and an intermediate flange 308 which is attached to and extends outwardly of the wall 102 at a height "$h_i$" which is less than the height "h" of the upper edge 106 relative to lower edge 104. The upper and intermediate flanges 306, 308 are preferably each made of the same material as wall 102, but may also be in the form of preformed thin straps sewn at their respective inner edges to the corresponding portions of wall 102. The exact choice of material and/or mode of connection are not considered critical. What is important, however, is that each of flanges 306, 308 be held firmly in an outwardly extended manner relatively to wall 102. This is most conveniently accomplished by attaching loops 310 to the outermost corners of upper flange 306 and similar loops 312 to the outermost corners of intermediate flange 308. Flexible connection elements 314 are then respectively connected to loops 310 and 312 and also to similar connection elements 318, 320 provided at suitable heights on corresponding support elements 116. As is obvious, connection elements 314 and 316 will be of different lengths, selected to ensure that respectively connected upper and intermediate flanges 306, 308 are properly tensioned outwardly. Making the connection elements 314, 316 of material with some elasticity is considered helpful in this regard.

As will be understood with reference to FIGS. 3(A) and 3(B), wind will approach the erected structure as indicated by the arrow "WIND". Sand particles 322 entrained therein, when they hit the outer surface of wall 102, will likely tend to move upwardly along its outer surface but will be intercepted by upper flange 310 and intermediate flange 308 at their respective heights. The intercepted sand will soon drop down by gravity. This will soon result in an accumulation 324 of sand on the upper surface of the outwardly extended base portion 302 and will weight it down and locate it in more stable manner.

Although the embodiment per FIGS. 3(A) and 3(B) has been shown with both an upper flange 306 and an intermediate flange 308, one or the other can be readily omitted, e.g., to save expense, reduce the weight of the overall apparatus, or because of a consequence of chosen dimensions. Thus a single flange 308, at a sufficient height to successfully intercept all entrained and oncoming sand, may eliminate the need for a higher level outward flange 306. In other words, the provision of one or two, or perhaps even more, outwardly extending flanges is considered to be a matter of design choice although, generally speaking, having more than one such outwardly extended flange should prove more efficient in entraining sand, particulate matter, and wind-blown debris of all kinds.

Figure 4:
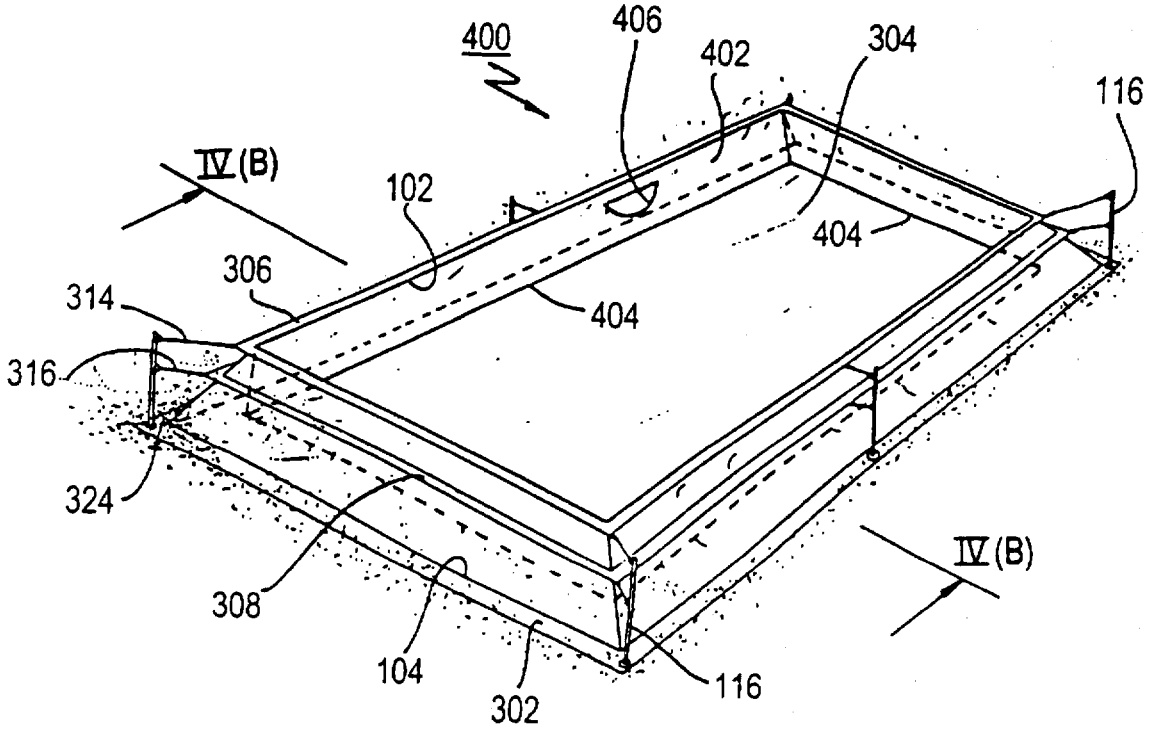
FIG. 4(A) is a perspective view of a fourth embodiment, shown erected over sandy ground.
FIG. 4(B) is a vertical cross-sectional view thereof, taken at Section IV(B)—IV (B).
Figure 4:
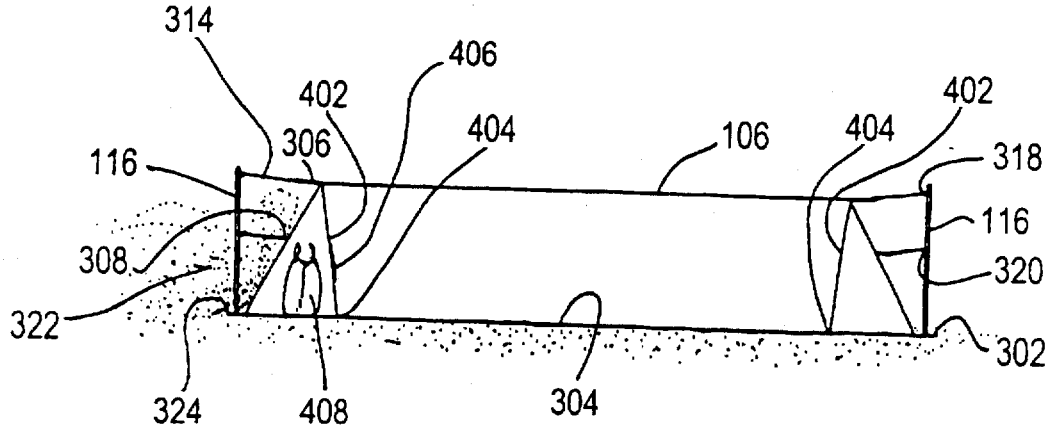

The fourth preferred embodiment 400, per FIGS. 4(A) and 4(B) differs from the third embodiment per FIGS. 3(A) and 3(B) in one very important regard, i.e., it is provided with an inside wall 402 which is connected to the upper edge 104 of outside wall 102 and has a lower edge 404 of its own. This edge 404 is sewn, adhered, or otherwise connected to the surface of the inside portion 304 of the base. The consequence is that an enclosed space, having a generally triangular cross-section, as best seen in FIG. 4(B), is defined all around the periphery of the shelter. A zipper 406, operable along a curved path, may for example be provided to selectively open and close an opening formed at suitable location in inside wall 402 to allow a user to place things within the enclosed space between the outer wall 102 and inner wall 402 in a safely closeable manner. Such zippers are widely used on flexible soft luggage, and the inclusion of one or more such zippers to close respective openings will enable a user to place items such as a package 408 safe from sun, wind and sand until required. Persons of ordinary skill in the art will immediately appreciate that the definition of such an enclosed space is not required all around the inside of wall 102, i.e., that an enclosed space can be readily defined along only a portion of wall 102 if desired. The structure for this is so simple and obvious that details thereof are not considered necessary here. A zipper is cited only as an example, and any known means may be substituted therefor to provide the desired closeable opening.

It may well be that a group of users, particularly if they desire a significant degree of privacy, may wish to have the structure made so that the upper edge of wall 102 is relatively high, e.g., over about 25 in. in height relative to the base. It would probably then be difficult for a relatively short person to easily step over the upper edge 106 to enter or leave the sheltered zone. There would, therefore, be merit in lowering at least a portion of the upper edge to a height such that all intended users could step over it. The fifth embodiment 500, per FIGS. 5(A) or (B) addresses this need. The structure of this embodiment is generally very similar to the structure of the fourth preferred embodiment per FIGS. 4(A) and 4(B) with one significant difference. The difference is that a portion 502 of the upper edge 104 is at a reduced height "$h_r$" than the height "h" of the rest of the upper edge 104.

Figure 5:
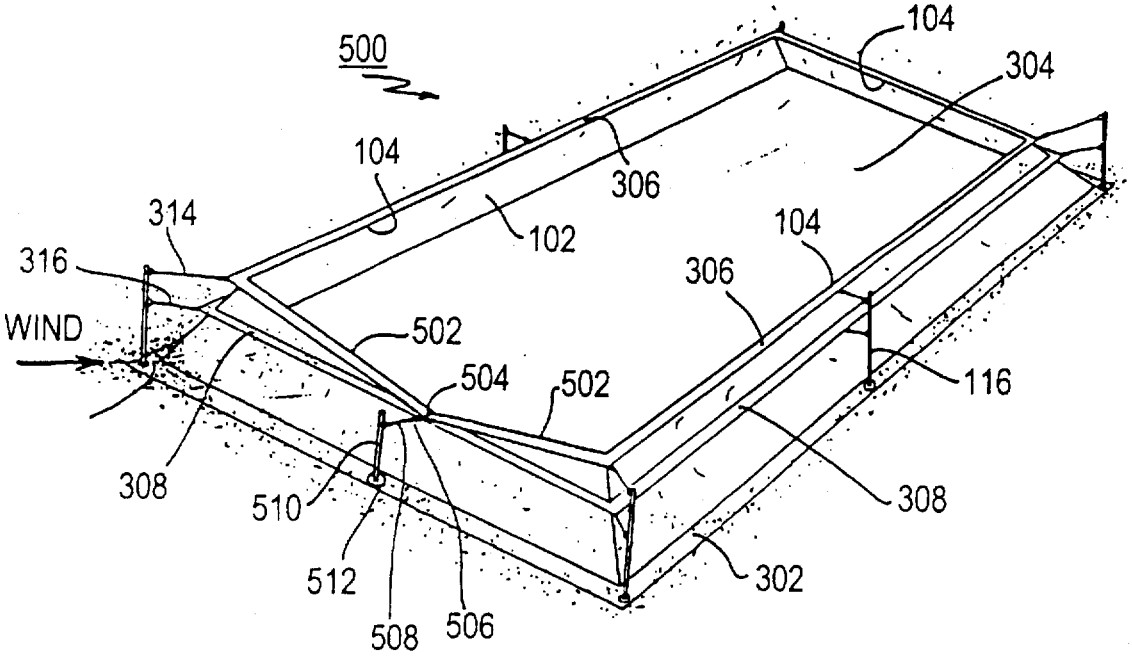
FIG. 5(A) is a perspective view of a fifth embodiment, wherein a portion of an upper edge of the structure inclines downward to facilitate stepping over thereat by a user.
FIG. 5(B) is an end elevation view of a modification thereof.
Figure 5:
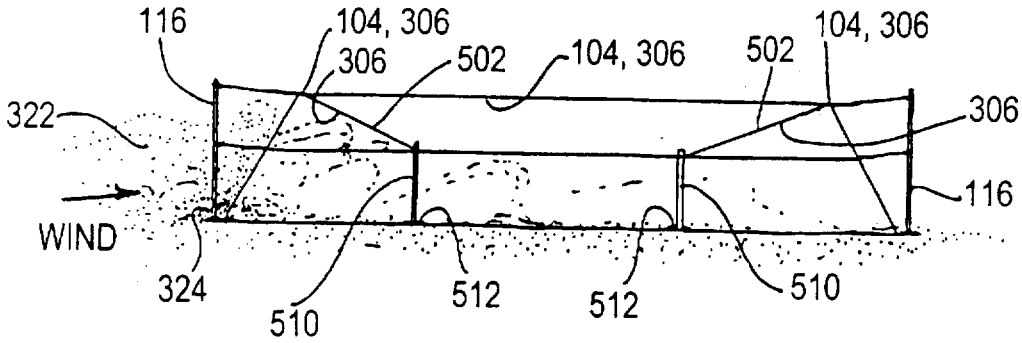

The embodiment per FIG. 5(A) has the central portion of a V-shape defined by the two inclined portions 502, 502 of upper edge 104 coming down to the level of intermediate outward flange 308. The upper and intermediate flanges 306, 308 may be connected thereat by a common seam 504. A loop 506 may be provided thereat and connected by a flexible/elastic connection element 508 to an upright support means 510 having a suitable height somewhat greater than "$h_r$". Support element 510 will have its lowermost portion projecting into the underlying ground through a suitably located grommet 512 provided in the outward portion 302 of the base of the structure. This will ensure that the wall 102, even while it has a V-shaped lowered portion at one end, will remain supported in stable and taut manner all around. It may be helpful to have this V-shaped portion in a downstream direction relative to the wind, although in FIG. 5(A) it is shown more or less facing the wind as indicated by the arrow "WIND". The point to be understood is that even with this V-shaped depression of the upper edge, provided the dimensions of the wall 102 are appropriate selected in light of the known wind strength, the apparatus should function satisfactorily for its intended purpose.

The embodiment shown in end view in FIG. 5(B) differs from the embodiment shown in perspective view in FIG. 5(A) in that a central approximately one-third or so of the upper flange 306 is indicated as made essentially coincident with a corresponding length of intermediate flange 308 to define a relatively wide lowered portion of the upper edge 104. In this embodiment, therefore, the inclined portions 502 of the upper edge 102 are inclined a little more steeply than in the embodiment of FIG. 5(A) and their lower ends are separated. This embodiment will also require the provision of two vertical support elements 510 each projecting downward through a correspondingly located grommet 512 (of which two must be provided) to adequately support the modified upper edge and upper flange tautly much as was done by support element 510 as discussed earlier. Note that FIG. 5(B) shows how sand 322 carried by the wind, as indicated by the arrow "WIND", is intercepted by the inclined portion of upper flange 306 and eventually falls past flange 308 onto and accumulates on the outwardly extended lower base portion 302.

FIG. 6 is intended to explain certain preferred features of an exemplary support element 116 which may be made of any suitable material to any suitable dimension. If it is made of a plastic, resin, composite or a metal, it may be readily molded or otherwise manufactured to have a radially extending smooth outward flange 602 below which extends the lowermost elongate portion 604 which is to be pushed into the ground. This lower portion 604 may be formed to have a pointed end 606 as indicated generally in broken lines. Preferably, flange 602 will be shaped and sized so as to fit comfortably over grommet 108 formed, for example, at a corner of the outwardly extending portion 302 of the base. Flange 602 is provided in part to facilitate application of a downward force by the user, because it provides a smooth conveniently shaped surface. The lower surface of flange 602 will rest on grommet 108 and, therefore, will not cause any undue stress on and tearing of the fabric of outward portion 302 of the base.

The upper end of support element 116, for example, may be conveniently provided with a through aperture 608 through which may be passed a ring 610 preferably made of a non-corrodible metal or a strong plastics material such as nylon. This would facilitate the easy connection of a hook or other connection means provided at a distal end of flexible/elastic connection element 314. The exact structural forms illustrated in FIG. 6 are not intended to be limiting but are merely exemplary. Thus, for example, the flexible/elastic element 314 may be like a conventional "bungee cord" which typically has an elastic rubber core surrounded by somewhat extensible fabric, or it may be solid molded rubber strap, a heavy weight rubber band, a spring, a chain, or any flexible element. Similarly, the connection with the upper end of supporting element 116 may be made in any known manner, i.e., the provision of a ring and hook 610, 612 is only one example and is not limiting. Furthermore, the provision of flange 602 is a matter of convenience and is not essential to successful use of the present invention.

FIG. 7 illustrates an exemplary and non-limiting structure of a simple fabric loop formed conveniently by the stitching of a strap-like length of material 702 along upper edge 104 of wall 102. By stitching across the width of the strap 702, a short extension length thereof may be readily converted into a flexible loop like loop 112 as used in the first preferred embodiment per FIGS. 1(A) and 1(B). The proximate end of a flexible/elastic connection element 126, having a retaining end 704, may be easily connected and disconnected to loop 112. As persons of ordinary skill in the art will immediately appreciate, if an outwardly extended flange is provided along the upper edge 104 that flange may be provided with grommets of suitable size and material, much as grommets 108 are provided in the outwardly extending portion 302 of the base. Again, it should be noted that minor details of structure and manner of use of such commonly known elements are not considered critical to the present invention.

FIG. 8 is intended to show to a somewhat larger scale a corner portion of a double-flanged wall 102, as may be encountered in any of the above-described third, fourth and fifth embodiments. Note that it may be convenient to form the outwardly extending flanges 306, 308 from preformed traps of strong material and uniform width, preferably in the range 0.5–2.0 in., respectively sewn or otherwise attached to the upper edge 104 (for upper flange 306) or wall 102 (for intermediate flange 308). As noted earlier, suitable grommets may be provided at the corners and pulling forces applied thereat, as indicated by short arrows "P", to keep the flanges extended outwardly. Sand particles entrained in the wind will impact on the outer surface of wall 102 or the undersurfaces of either or both of outwardly extended flanges 306 and 308 and, eventually, will fall and slide downward along wall 102 until they accumulate on the upper surface of the outwardly extended portion 302 of the base to weight and press the same down towards the ground.

As generally indicated earlier, for prolonged and trouble-free use of the invention, it may be helpful to select weather-resistant materials such as nylon or polyester for the walls and base, nylon or non-corrodible metal such as aluminum for the grommets and hooks, nylon for preformed straps, etc., with the wall support elements made of plastic, composite, or nylon-type material. Such materials are commonly available and employed to make camping supplies like ground sheets, tents, etc. Their availability and manner of use are, therefore, well understood.

To improve personal comfort in use of the invention, some users may desire to have a pad or some form of resilient flat element permanently or detachably affixed to the inside portion 304 of the base in the third, fourth and fifth embodiments as discussed above. Such a resilient element could be a pad or fluffy blanket-like material with conventional connection means, e.g., zippers, snap buttons or the like, or may even be permanently sewn to the inside portion of the base to provide a padded floor to the sheltered zone. Since the manner in which such a pad may be attached to the rest of the structure is merely a matter of design choice, and numerous alternatives are known and available, additional details thereof are not considered necessary. Persons of ordinary skill in the art can thus enhance the comfort and convenience with which this invention may be practiced.

On a final note concerning comfort and convenience, it is well-known that along many of the beaches of the United States, especially on the Atlantic side, there are nasty stinging insects which annoy beachgoers. A user of the present invention can enjoy not only freedom from chilly winds and entrained jetsam but, with the disposition of a simple thin, light, highly perforate net extended over the tautly-held upper edge 104, may also very conveniently exclude such stinging insects from the sheltered zone. As generally indicated in FIG. 7, such a net 1000 may be provided at its outer edges with means for connecting to portions of the wall 102 near it supper edge 104. Such connection means may simply be braces 1002, snap buttons, or any other known means. The user can then easily attach such a net after entering the sheltered zone and may easily detach it whenever he or she wants to leave the sheltered zone to enjoy troublefree extensive use of the invention without adding significantly to the weight, cost or complexity in its use.

As indicated in FIG. 8, a small transparent piece of plastic material may be utilized to create a small "see-through" window 800 in wall 102. This would enable a pet or small child left inside the sheltered zone to look out without getting sand it its eyes. It would also enable a user, for example one sunbathing in the nude, to see approaching persons and to thereby have time to cover up.

If wall 102 is given a height "h" 6 ft. or higher, and the base 304 made commensurately large also, the shelter can be used in a yard, garden, or even on a beach, as a privacy shelter into which passersby cannot peek. Such a shelter would be an obvious modification of the disclosed embodiments and would be useful even when the wind is not cold and also where there is no blowing jetsam. For a shelter with wall 102 everywhere of significant height, a zippered or snap-fitted opening may conveniently be provided in wall 102 to provide an easily closeable port of entry and exit. Such a port may have any suitable shape and, except that it would be located in the inwardly inclined wall 102, could have the type of structure described for closeable opening 406 in the fourth embodiment per FIG. 4(A).

Although the present invention has been described and illustrated in detail, it should be clearly understood that the same is by way of illustration and example only and is not to be taken by way of limitation, the spirit and scope of the present invention being limited only by the terms of the appended claims.

What is claimed is:

1. An apparatus for sheltering from wind and any jetsam entrained therewith, comprising:

a wall having a lower edge and an upper edge and extending therebetween to circumscribe and define an open sheltered zone; and wall-support means for supporting substantially the entire upper edge above the lower edge so that a substantial portion of the wall is inclined toward an interior of the sheltered zone.

2. The apparatus according to claim 1, further comprising:

jetsam intercepting means connected to the wall and disposed for intercepting any jetsam driven by wind over an outer surface of the wall.

3. The apparatus according to claim 2, wherein:

the jetsam intercepting means comprises at least one flange extending outwardly away from the outer surface of the wall above the lower edge.

4. The apparatus according to claim 1, further comprising:

a base attached to the lower edge of the wall.

5. The apparatus according to claim 4, wherein:

the base extends from the lower edge of the wall outwardly of the sheltered zone.

6. The apparatus according to claim 4, wherein:

the base extends inwardly from the lower edge of the wall to define a lower surface of the sheltered zone.

7. The apparatus according to claim 4, wherein:

the base has an inside portion which extends inwardly from the lower edge of the wall to define a lower surface of the sheltered zone, and the base also has an outside portion which extends from the lower edge of the wall outwardly of the sheltered zone.

8. The apparatus according to claim 1, wherein:

the upper edge and the lower edge of the wall are each endless and provide respective closed upper and lower peripheries of the wall, the upper periphery being shorter in length than the lower periphery.

9. The apparatus according to claim 1, wherein:

the wall-support means comprises a plurality of support elements having respective upper and lower end portions, the lower end portions being disposed adjacent the lower edge and the upper end portions being disposed adjacent the upper edge to support the upper edge above the lower portion.

10. The apparatus according to claim 9, wherein:

the lower end portions of the support elements cooperate to hold down the lower edge to a support surface.

11. The apparatus according to claim 9, further comprising:

means for resiliently connecting the upper end portions of the support elements to the upper edge.

12. The apparatus according to claim 11, wherein:

the lower end portions of the support elements cooperate to hold down the lower edge to a support surface.

13. The apparatus according to claim 8, further comprising:

a base attached to the lower edge of the wall and extending to define a lower surface of the sheltered zone; and an inner wall connecting an upper portion of said wall to the base inwardly of the lower edge to define a space between said wall and the inner wall.

14. The apparatus according to claim 13, wherein:

the inner wall has a closeable opening to allow a user to selectively access or close off said space.

15. The apparatus according to claim 13, wherein:

the inner wall has a reflective surface oriented to reflect incident sunlight toward the interior of the sheltered zone.

16. The apparatus according to claim 3, further comprising:

a base attached to the lower edge of the wall;

wherein the base has an inside portion which extends inwardly from the lower edge of the wall to define a lower surface of the sheltered zone, and the base also has an outside portion which extends from the lower edge of the wall outwardly of the sheltered zone.

17. The apparatus according to claim 16, wherein:

the wall-support means comprises a plurality of support elements having respective upper and lower end portions, the lower end portions being disposed adjacent the lower edge and the upper end portions being disposed adjacent the upper edge to support the upper edge above the lower portion; and the lower end portions of the support elements cooperate to hold down the lower edge to a support surface.

18. The apparatus according to claim 17, further comprising:

means for resiliently connecting the upper end portions of the support elements to the upper edge; and a base attached to the lower edge of the wall and extending to define a lower surface of the sheltered zone.

19. The apparatus according to claim 4, further comprising:

a padded element cooperating with the base to provide a compliant support to a user in the sheltered zone.

20. The apparatus according to claim 18, further comprising:

a padded element cooperating with the base to provide a compliant support to a user in the sheltered zone.

21. The apparatus according to claim 2, wherein:

the jetsam intercepting means comprises first and second flanges both extending outwardly away from the outer surface of the wall.

22. The apparatus according to claim 21, wherein:

a substantial portion of the first flange is at the height of the upper edge and the entire second flange is lower than the upper edge.

23. The apparatus according to claim 22, wherein:

portions of the first and second flanges are coextensive.

24. The apparatus according to claim 21, wherein:

the support elements enable the first and second flanges to extend outwardly away from the outer surface.

25. The apparatus according to claim 1, further comprising:

a flexible, light, net-like element extendable over the upper edge to exclude insects from the sheltered zone.

26. The apparatus according to claim 8, further comprising:

a closeable opening in the wall.

27. The apparatus according to claim 8, wherein:

a portion of the wall is formed of a transparent material.

28. An apparatus for sheltering a user from wind and any jetsam entrained therewith, comprising:

a wall having a lower edge and an upper edge and extending therebetween to circumscribe and define an open sheltered zone;

wall-support means for supporting substantially the entire upper edge above the lower edge so that at least a portion of the wall facing to a wind is inclined toward an interior of the sheltered zone, and jetsam intercepting means connected to the wall and disposed for impeding entry into the sheltered zone of any jetsam driven by wind over an outer surface of the wall.

29. An apparatus for sheltering from wind and any jetsam entrained therewith, comprising:

a wall having a lower edge and an upper edge and extending therebetween to circumscribe and define an open sheltered zone;

wall-support means for supporting substantially the entire upper edge above the lower edge so that at least a portion of the wall facing to a wind is inclined toward an interior of the sheltered zone; and a base attached to the lower edge of the wall and extending from the lower edge of the wall outwardly of the sheltered zone.

30. An apparatus for sheltering from wind and any jetsam entrained therewith, comprising:

a wall having a lower edge and an upper edge and extending therebetween to circumscribe and define an open sheltered zone;

wall-support means for supporting substantially the entire upper edge above the lower edge so that at least a portion of the wall facing to a wind is inclined toward an interior of the sheltered zone; and a flexible net-like element extendable over the upper edge to exclude insects from the sheltered zone.

31. An apparatus for sheltering from wind and any jetsam entrained therewith, comprising:

a wall having a lower edge and an upper edge and extending therebetween to circumscribe an open sheltered zone, wherein ends of the wall overlap; and wall-support means for supporting substantially the entire upper edge above the lower edge so that at least a portion of the wall facing to a wind is inclined toward an interior of the sheltered zone.

32. The apparatus according to claim 31, further comprising:

a base attached to the lower edge of the wall and extending from the lower edge of the wall outwardly of the sheltered zone.

33. The apparatus according to claim 31, further comprising:

a base attached to the lower edge of the wall and extending inwardly from the lower edge of the wall to define a lower surface of the sheltered zone.

34. The apparatus according to claim 31, further comprising:

jetsam intercepting means connected to the wall and disposed for impeding entry into the sheltered zone of any jetsam driven by the wind over an outside surface of the wall.

* * * * *